United States Patent [19]

Brandt

[11] 4,289,279

[45] Sep. 15, 1981

[54] MILL LINING

[75] Inventor: Bertil Brandt, Paris, France

[73] Assignee: Trelleborg AB, Trelleborg, Sweden

[21] Appl. No.: 92,151

[22] Filed: Nov. 7, 1979

Related U.S. Application Data

[63] Continuation of Ser. No. 905,510, May 12, 1978, abandoned.

[30] Foreign Application Priority Data

May 16, 1977 [FR] France ..... 77 05693

[51] Int. Cl.[3] ..... B02C 17/22

[52] U.S. Cl. ..... 241/102; 241/183

[58] Field of Search ..... 241/102, 181–183, 241/284, DIG. 30, 299

[56] References Cited

U.S. PATENT DOCUMENTS

| | | | |
|---|---|---|---|
| 1,539,237 | 5/1925 | Borcherdt | 241/183 X |
| 1,690,493 | 11/1928 | Marcy | 241/183 X |
| 3,107,867 | 10/1963 | Suensson et al. | 241/102 |
| 3,378,209 | 4/1968 | Chrocheron | 241/182 |
| 3,462,090 | 8/1969 | Candes et al | 241/299 |
| 3,680,799 | 8/1972 | Hallerback | 241/183 |
| 3,910,756 | 10/1975 | Henning | 241/183 X |

FOREIGN PATENT DOCUMENTS

| | | | |
|---|---|---|---|
| 2002536 | 7/1971 | Fed. Rep. of Germany | 241/DIG. 30 |

*Primary Examiner*—Howard N. Goldberg

*Attorney, Agent, or Firm*—Beveridge, DeGrandi, Kline & Lunsford

[57] ABSTRACT

A mill lining is disclosed, intended for e.g. a primary or autogenous mill in the mining industry. The lining comprises shell plates and lifter bars made from elastomer material and mounted in a mill drum. The lifter bars extend substantially in the axial direction of the mill drum and project into the mill drum beyond the inner surface of the shell plates. At least some of the lifter bars, preferably every second, are designed to act as elastomer springs by having a longitudinal recess or slot in their impact front side facing forwardly in the contemplated direction of rotation of the mill drum. The recess or slot is inside the inner surface of the shell plates and serves as a strain concentrator concentrating the tensile strain of the lifter bars to an area relatively unexposed to sliding abrasion of the material being ground.

10 Claims, 14 Drawing Figures

MILL LINING

This is a continuation of application Ser. No. 905,510, filed May 12, 1978, now abandoned.

The present invention relates to a lining for mills, in particular, but not exclusively, for mills of the type used as primary mills in the mining industry, for example, primary autogenous mills in which the individual pieces of the material being ground themselves serve as mill balls and the grinding is thus realized by a combination of the mutual impact and abrasion effect between the individual material pieces; or in primary semiautogenous mills in which separate mill balls are added apart from the fact that the individual pieces of the material being ground themselves serve also as milling balls. One type of such a lining is constituted by shell plates mounted in a mill drum and lifter bars which consist of elastomer material and extend substantially in the axial direction of the mill drum and which project, seen from the innerside of the shell plates, inwardly into the mill drum so as to serve as retarding, agitating and lifting means which increase the occurrence of crushing and abrasive impact between the individual material pieces of the material being ground.

The primary autogenous mills are often of considerable dimensions with, for example, a diameter of 6 m and a length of over 10 m or a diameter of 9 m and a length of 4 m, the material to be ground being fed in through a centrally located opening in one end, the supply end, and, during the rotation of the mill drum about its longitudinal axis, being then progressively moved towards the other end of the mill drum, the discharge end, where the material being ground is discharged through a centrally located outlet opening in the end wall, the discharge opening being often covered by a grate so as to release only the ready-ground material. The lifter bars mounted between the shell plates are sometimes of equal height and often project 30–50 cm from the inside of the shell plates, but in certain cases, the lifter bars are of different heights, every second one being, for example, 30–50 cm high and every second one 10–20 cm high. The lifter bars may either be oriented fully axially in the mill or also be slightly inclined toward the axial direction so that the lifter bars, in the latter case, will exercise a sorting effect on the material being ground, apart from the above-mentioned retarding, agitating and lifting effects. Irrespective of the orientation of the lifter bars, they are exposed to a heavy abrasion effect, with the result that their side facing forwardly in the direction of rotation of the mill, i.e. the impact or front side which is struck by the material being ground on rotation of the mill drum, becomes rapidly worn out, whereby the height of the lifter bars, and thereby their agitating effect, is reduced to an unsuitable extent after only a few months' operation. This wear is most noticeable at the supply and discharge ends of the mill in the above-mentioned long mills.

A study of the prior art linings has shown that this powerful abrasion of the lifter bars probably depends on the fact that the impact side of the lifter bars is exposed to a great extent to a sliding abrasion at the same time as it is exposed to tensile strain since the lifter bars yield to the impact from the often very large material pieces in the material being ground. Attempts have been made to counteract this strain by the selection of harder elastomer qualities, but the lifter bars have then on many occasions instead displayed greater sensitivity to crush and cut damages in the elastomer material.

One object of the present invention is to obviate to a great extent the disadvantages inherent in the prior art linings for mills, in particular for primary autogenous mills.

Another object of the present invention is to enable the use of a softer lifter bar elastomer material.

A further object of the present invention is to provide a lifter bar being designed so as to function as an elastomer spring.

According to the present invention it is possible to obtain these and further objects by a special design of at least some of the lifter bars, preferably every second or every third, the tensile strain in the lifter bar material, caused by the impact on the impact side of the lifter bars, being concentrated to a point which is located under relatively great protection against sliding abrasion. According to the invention, the lifter bars in question are, therefore, designed as elastomer springs by having a longitudinal recess or slot in their impact side facing forwardly in the contemplated direction of rotation of the mill drum, said recess or slot being inside the inner surface of the shell plates. As a result, the major portion of the tensile strain in the elastomer material of the lifter bars will be concentrated to this longitudinal recess or slot where the material being ground does not slide along the surface of the lifter bars to any greater extent. On the other hand, in conventional lifter bars, the elastomer material will be exposed to tensile strain throughout substantially its entire impact surface, whereby this is progressively worn down to a convexly arched shape. The lifter bars designed as elastomer springs with a longitudinal recess or slot are not worn down as rapidly and, above all, the top of the lifter bars, that is to say the portion closest the centre of the mill drum, remains intact for a considerably longer time. The sliding abrasion of the impact side of the lifter bars in question may, in this case, be further reduced if the outer portion of these lifter bars is formed, in accordance with a particularly preferred embodiment of the present invention, with a longitudinal protuberance or ridge on the impact side, located outside the longitudinal recess or slot, for absorbing impact stresses from large bodies included in the charge of material being ground in the mill, and for forming a longitudinal channel or bucket located inside this protuberance or ridge for trapping bodies included in the charge of material to be ground. These last-mentioned bodies will, for that period of time in which the lifter bar carries out its lifting effect, lie relatively still and thereby serve as an "abrasion layer" along which other bodies and particles in the charge slide.

Another advantage in the lining according to the invention is that it is possible to select a softer elastomer material in the lifter bars designed as elastomer springs with a longitudinal recess or slot, this being advantageous from the wear and crushing points of view—the increase of the tensile strain in these lifter bars, caused by their greater softness, when the lifter bars are struck by the material being ground is concentrated, to a major degree, to the region of the longitudinal recess or slot, where the lifter bar in any event is not exposed to any great amount of sliding abrasion from the material being ground.

The nature of the present invention and its aspects will be more readily understood from the following brief description of the accompanying drawings, and the discussion relating thereto.

In the accompanying drawings:

FIGS. 1 and 2 are cross-sections through conventional lifter bars and shell plates lying beside them in a conventional mill lining;

FIG. 3*a* is a cross-section through a portion of the mill shell in a prior art mill whose high lifter bars have been partially worn out;

FIG. 3*b* is a corresponding cross-section through an example of a mill according to the present invention;

Figure 2:
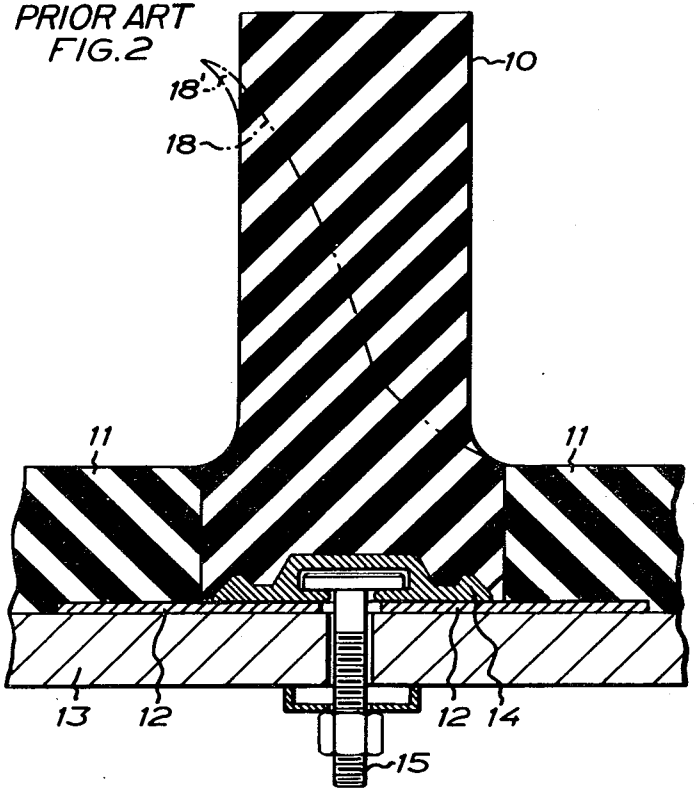
PRIOR ART FIG. 2
Figure 1:
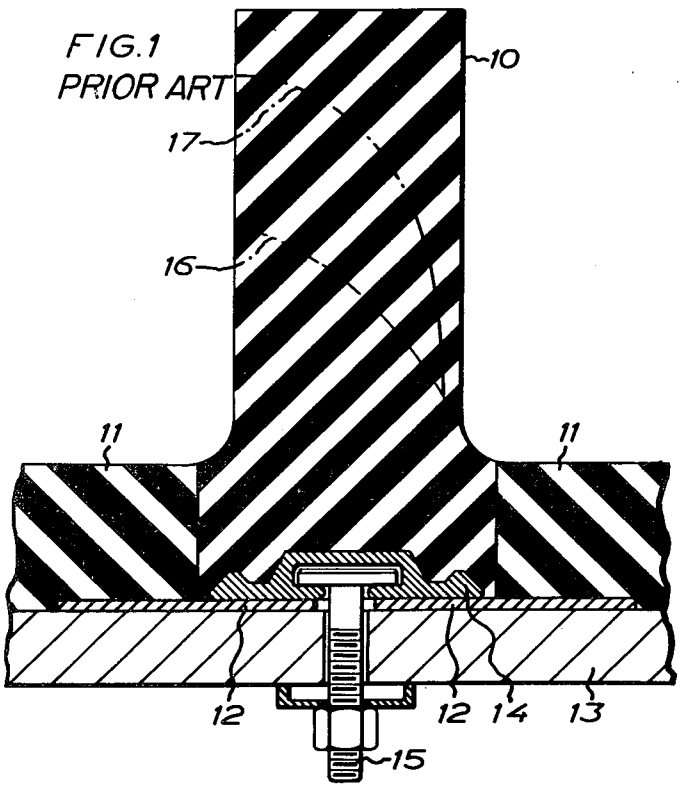
FIG. 1 PRIOR ART

In FIGS. 1 and 2 are shown sections through a lifter bar 10 which is inserted between shell plates 11 made from an elastomer, preferably abrasion resistant rubber. These shell plates 11 have projections 12 in the form of backing metal plates bonded to the underside of the elastomer shell plates during the vulcanization thereof. These backing plates or projections 12 project under the lifter bars 10 and are fixedly clamped against the shell 13 of a mill drum when channel profiles 14 vulcanized into the lifter bars are drawn down towards the shell 13 by means of mounting bolts or T-bolts 15. Three different patterns of wear are shown in FIGS. 1 and 2, the dash-dot line 16 in FIG. 1 marking the wear pattern at the supply end of a mill drum and the dash-dot line 17 marking the wear curve approximately midway between the supply and discharge ends of the mill, and the dash-dot line 18 in FIG. 2 showing the wear curve close to the discharge end of the mill. At this end, there sometimes occurs a lip-like projection 18'.

It is believed that the wear curves, shown in FIGS. 1 and 2, in the conventional mills, particularly in primary autogenous mills for use within the mining industry, depend upon the fact that the lifter bars are exposed on their impact side to a combined strain and abrasion effect in that the material being ground slides along the impact side while this is under tensile strain. This combined strain and abrasion effect accelerates the wear of the lifter bars.

Figure 3A:
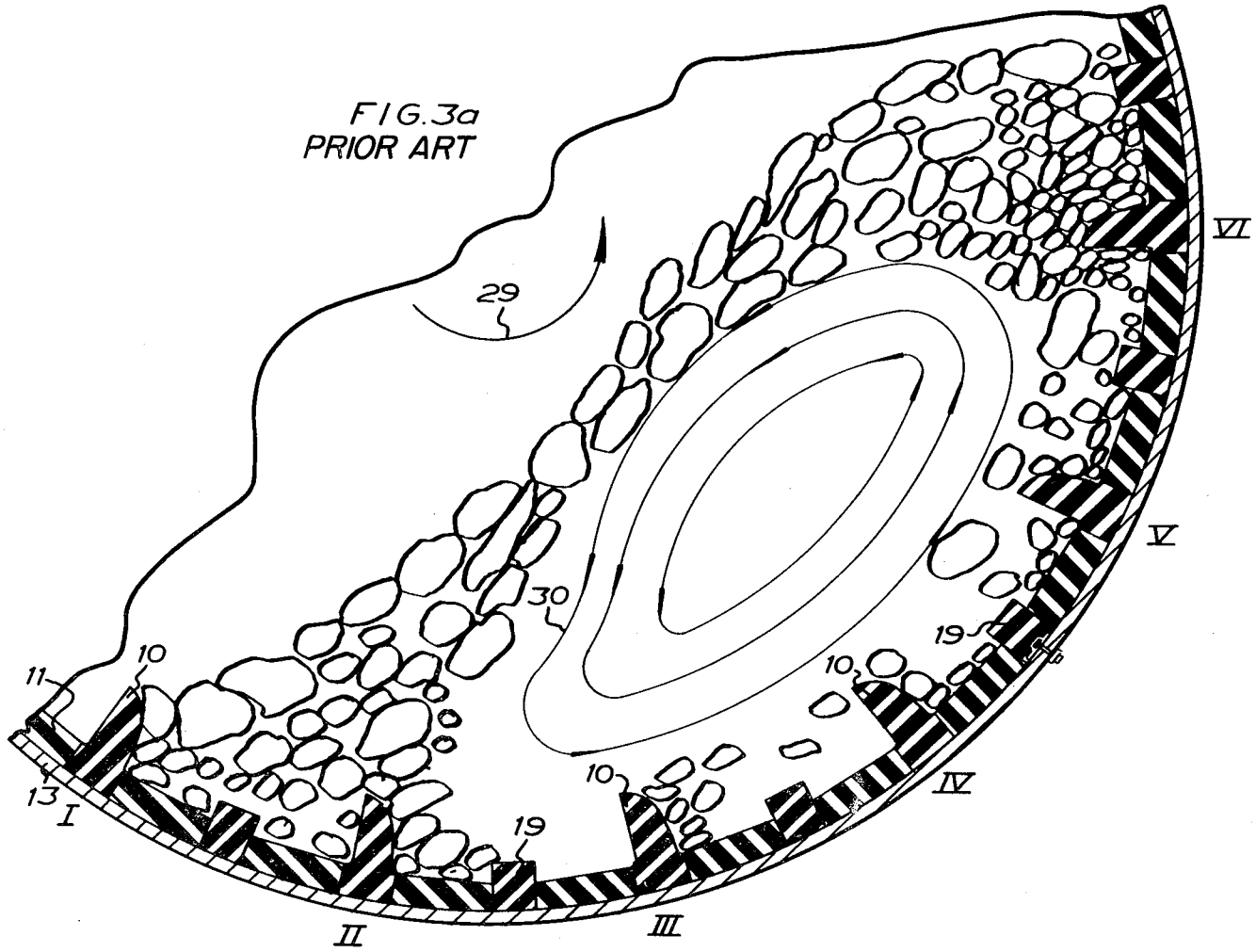
FIG. 3a PRIOR ART

In FIG. 3*a* there is shown a prior art mill lining with high lifter bars 10 having been partly worn down. Low lifter bars 19 are located between these high lifter bars. The mill rotates in the direction of the arrow 29 and the charge in the mill moves approximately in that flow pattern which is illustrated by means of lines 30. The lifter bar in position I is in position to receive large impact stresses from large-size bodies in the material being ground which roll on the charge, and this lifter bar then takes care of the material being ground which is located between the lifter bars in position I and II and carries this material in the upward movement of the mill shell. The lifter bars in positions II, III, IV and V are to resist the pressure caused by the lifting of this heavy charge. Between the lifter bars in positions V and VI, the loosening of the charge begins and it is probably within this zone that, in particular, the lifter bar in position VI is exposed to powerful abrasion while being exposed to tensile strain in the material at its impact surface.

Figure 3B:
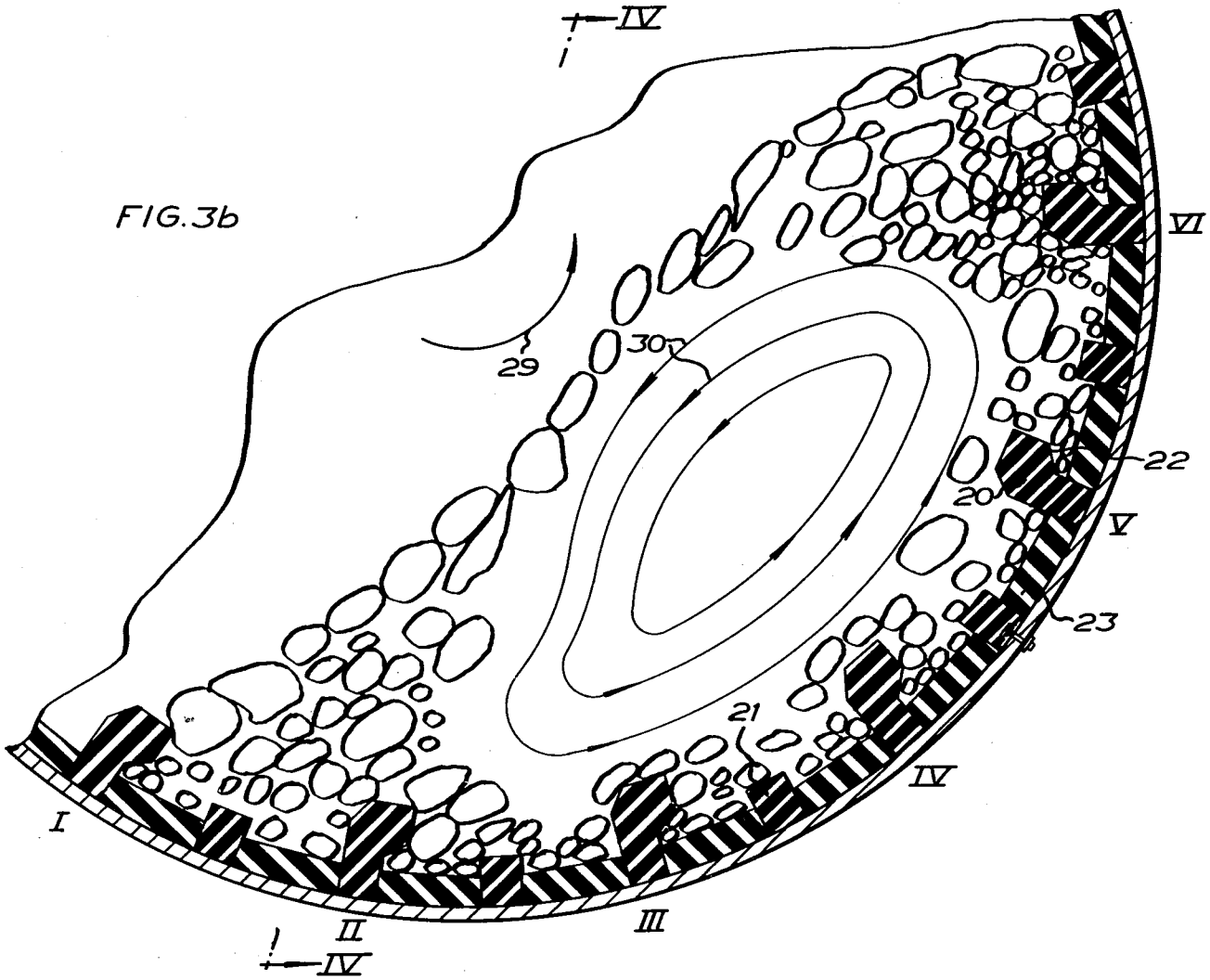

The present invention now produces a mill lining which is preferably designed according to that illustrated in FIG. 3*b,* in which every second lifter bar 20 is made higher than the remaining lifter bars 21 and is provided with a longitudinal recess 22. The lifter bars are made from a wear resistant or heavy duty elastomer material, e.g. synthetic or natural rubber, and have a channel profile 25 vulcanized into the elastomer material. Shell plates 23 are placed between the various lifter bars and also consist of a heavy-duty elastomer material and (as is apparent, for example, from FIG. 6) have projections in the form of metal plates 24 which are bonded to the underside of the shell plates during the vulcanization thereof and which are fixedly clamped by the channel profile 25 of the lifter bar against the shell 26 of the mill drum by means of T-bolts 27.

In operation, the mill drum rotates about its longitudinal axis 28 in the direction of the arrow 29. In this case, the material being ground will move in that flow pattern which is illustrated by means of lines 30. The large bodies of material which roll down along the surface of the charge and strike the lifter bar 20 in position I will cause an elastic deflection of the lifter bar, this deflection taking place substantially on a level with the recess 22 and the tensile strain on the elastomer material being thus concentrated to a great extent to a region where the lifter bar is not exposed to sliding abrasion. When the lifter bars 20 then progressively move past positions II, III, IV, V and VI, the bodies of material being ground will lie to a great extent captive in the groove or recess 22, whereby sliding abrasion is further reduced. In position VI, where the charge, like that in the prior art mill, is loosened and begins its downward movement in the form of a cascade, the bodies of material lying in the groove or recess will serve as an "abrasion layer" or extra protection for the elastomer material in that region where the material is under tensile stress as a consequence of the outward bending of the lifter bars under the influence of the heavy charge. The effect will be that the abrasion of the lifter bar material proper is considerably reduced with a consequential increase of the service life of the lifter bar.

Figure 4:
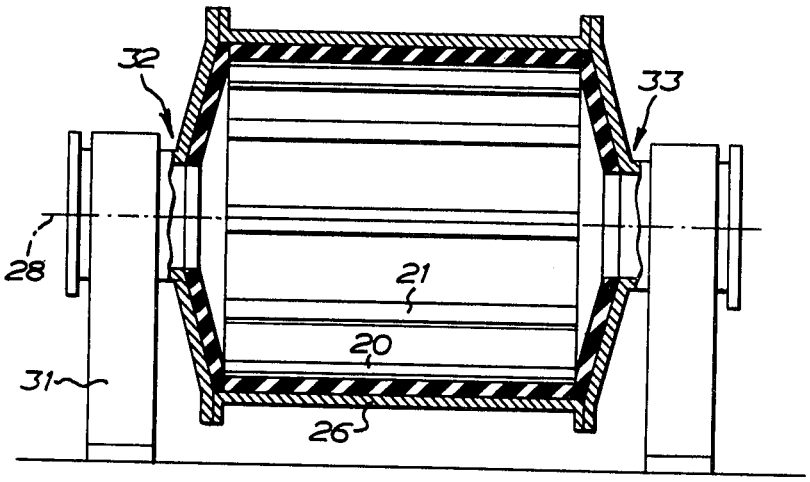
FIG. 4 is a section taken along the line IV—IV in FIG. 3*b;*

As is illustrated in FIG. 4, the lifter bars 20 and 21 may be oriented axially in the mill drum 26. It is also apparent from FIG. 4 that the mill drum is mounted for rotation in a frame 31, the material to be ground being fed into the mill at the supply end 32 of the drum and discharged from the mill at the discharge end 33 of the drum.

Figure 5:
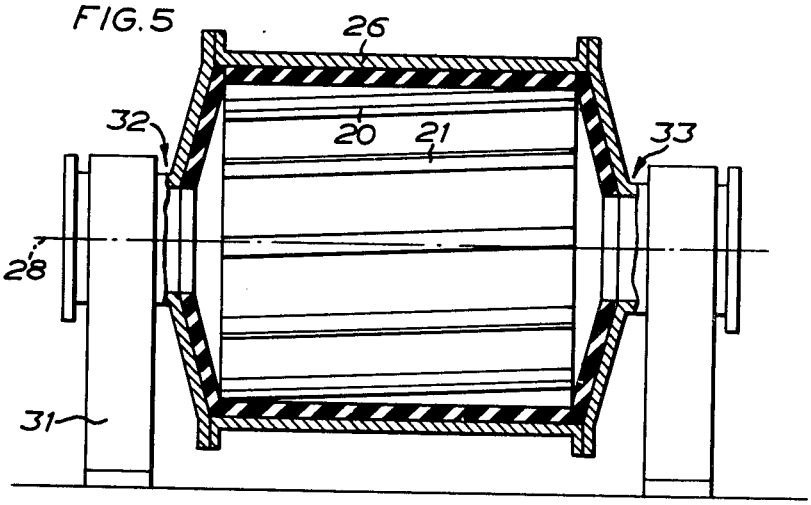
FIG. 5 is a longitudinal section, corresponding to FIG. 4, through a modified embodiment of the mill according to the present invention.

It will be seen from FIG. 5 that the lifter bars 20, 21 may also be inclined in relation to the longitudinal axis 28 of the drum so that the lifter bars will carry out a per se known sorting effect on the material which is being ground.

Figure 6:
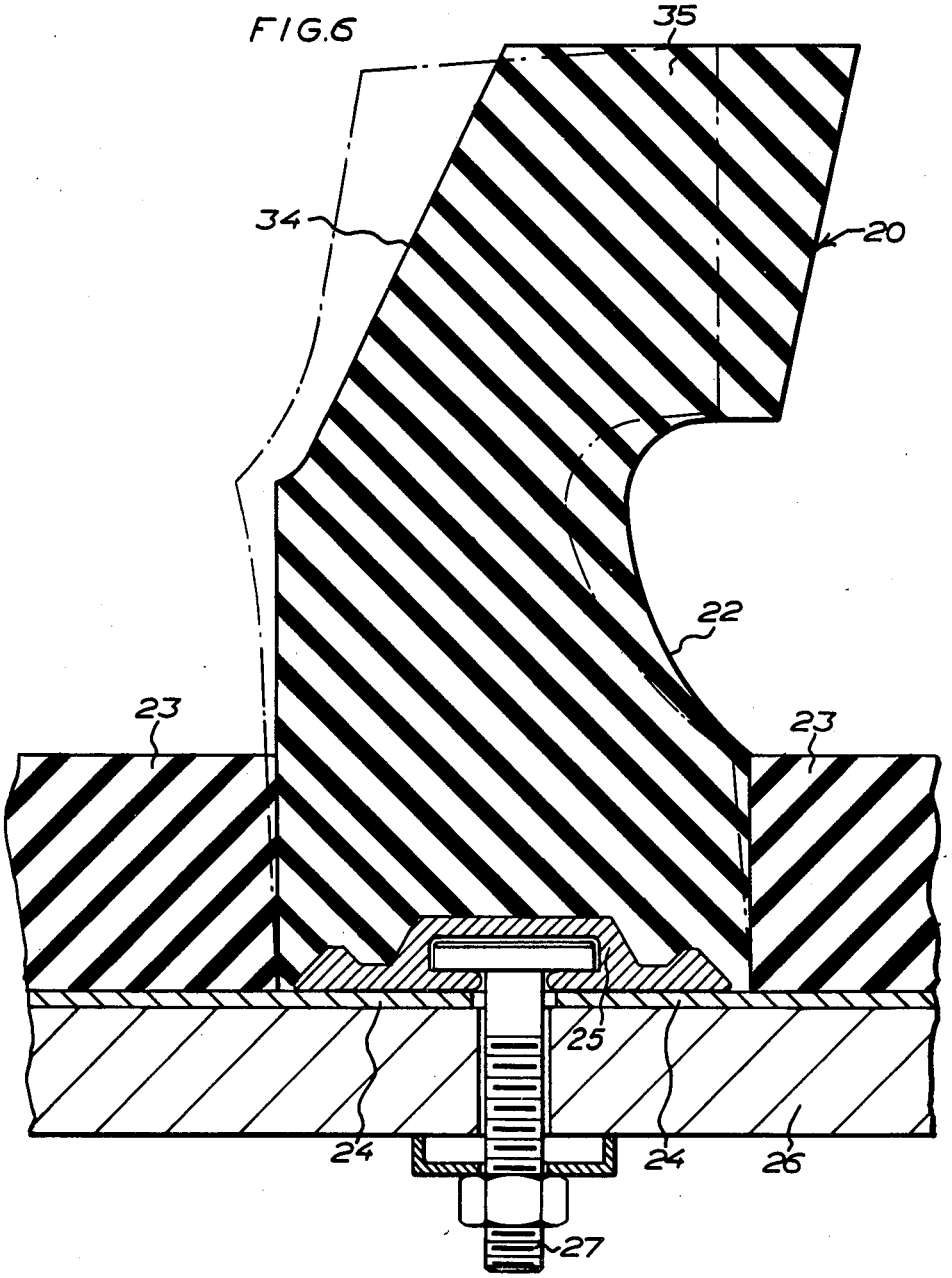
FIGS. 6 to 9 show four further examples of a lifter bar included in the mill lining according to the invention.

FIG. 6 shows, on a larger scale, one embodiment of the lifter bars 20 and shell plates 23. The skilled reader will note from this figure that the recess 22 is deep and will, therefore, form an indication of strain, at which the major part of the elastic tensile strain on the impact side of the lifter bars (the side facing to the right in FIG. 6)

occurs when the lifter bar, under the influence of the material being ground (and in particular of large rocks or ore pieces included in the material) are bent to the left with respect to FIG. 6. Broken lines intimate how the lifter bar 20 is bent under such influence and, on a comparison between the neutral position shown with solid lines and the bent position shown with broken lines, it is easy to ascertain that the major part of the deformation in this bending takes place in the region of the bottom of the recess 22. It is also apparent from FIG. 6 that the recess 22 commences approximately on a level with the inside of the shell plates 23. The lifter bar shown in this figure has, thus, substantially C-shaped cross-section with a bevelling 34 on its side opposite the recess 22. The top portion 35 of the lifter bar will thus receive the major portion of the impact and thereby yield resiliently to this impact in that a bending of the lifter bar takes place under tensile strain substantially only in the bottom region of the recess 22.

Figure 7:
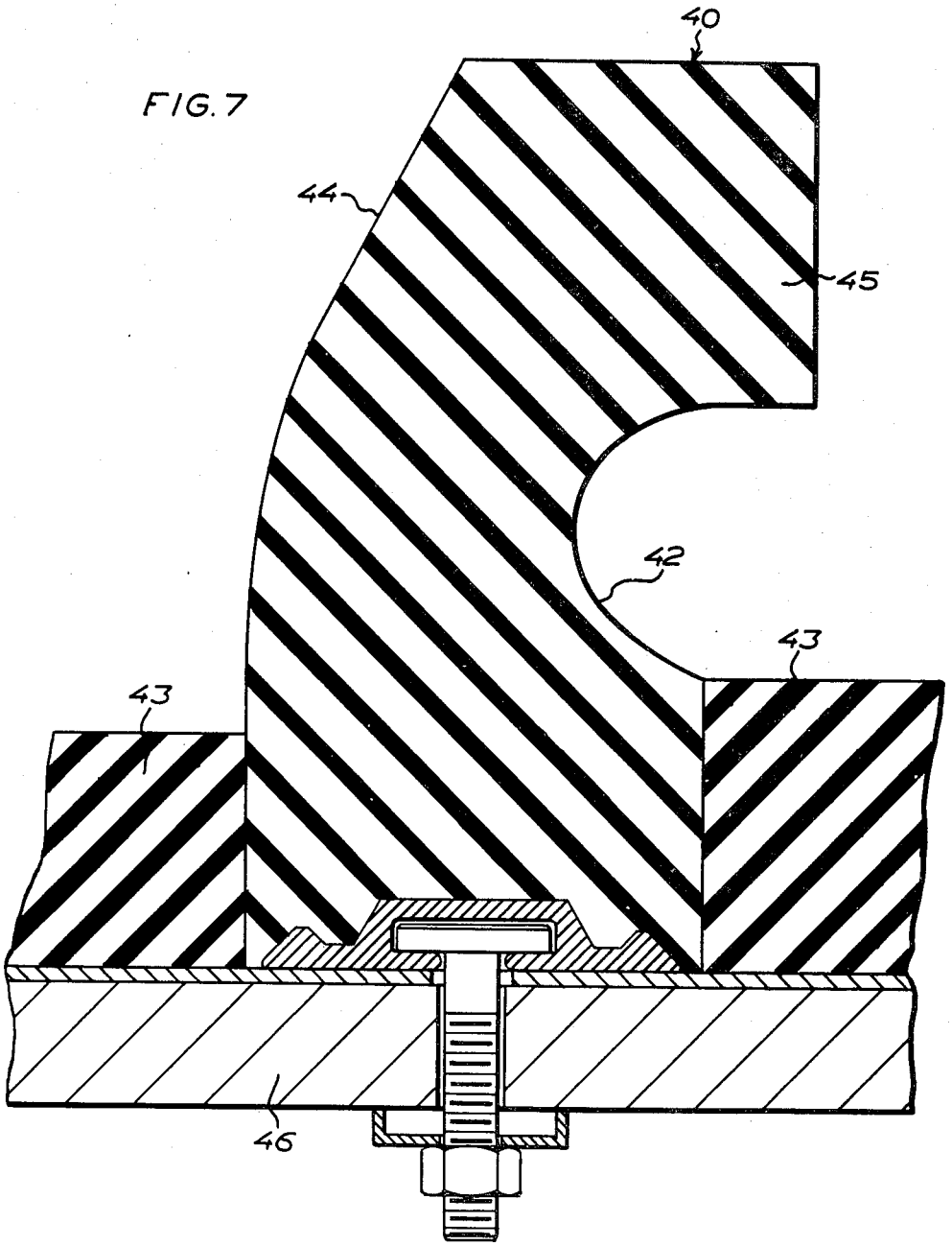

In FIG. 7 is shown a further example of a mill lining according to the present invention. Also in this case, there is shown only one of the lifter bars 40 and shell plates 43 located on either side thereof. The clamping of the lifter bar and the shell plates 43 against the mill drum 46 is effected in the same manner as in the embodiment according to FIG. 6. Like the lifter bar 20, the lifter bar 40 has a recess 42 which commences approximately on a level with the inside of the adjacent shell plate 43 and terminates below the top portion 45 of the lifter bar. The lifter bar 40 has, instead of a bevelling 34, been formed with a completely arched rear side 44. Otherwise, this lifter bar operates in the same manner as the lifter bar according to FIG. 6.

Figure 8:
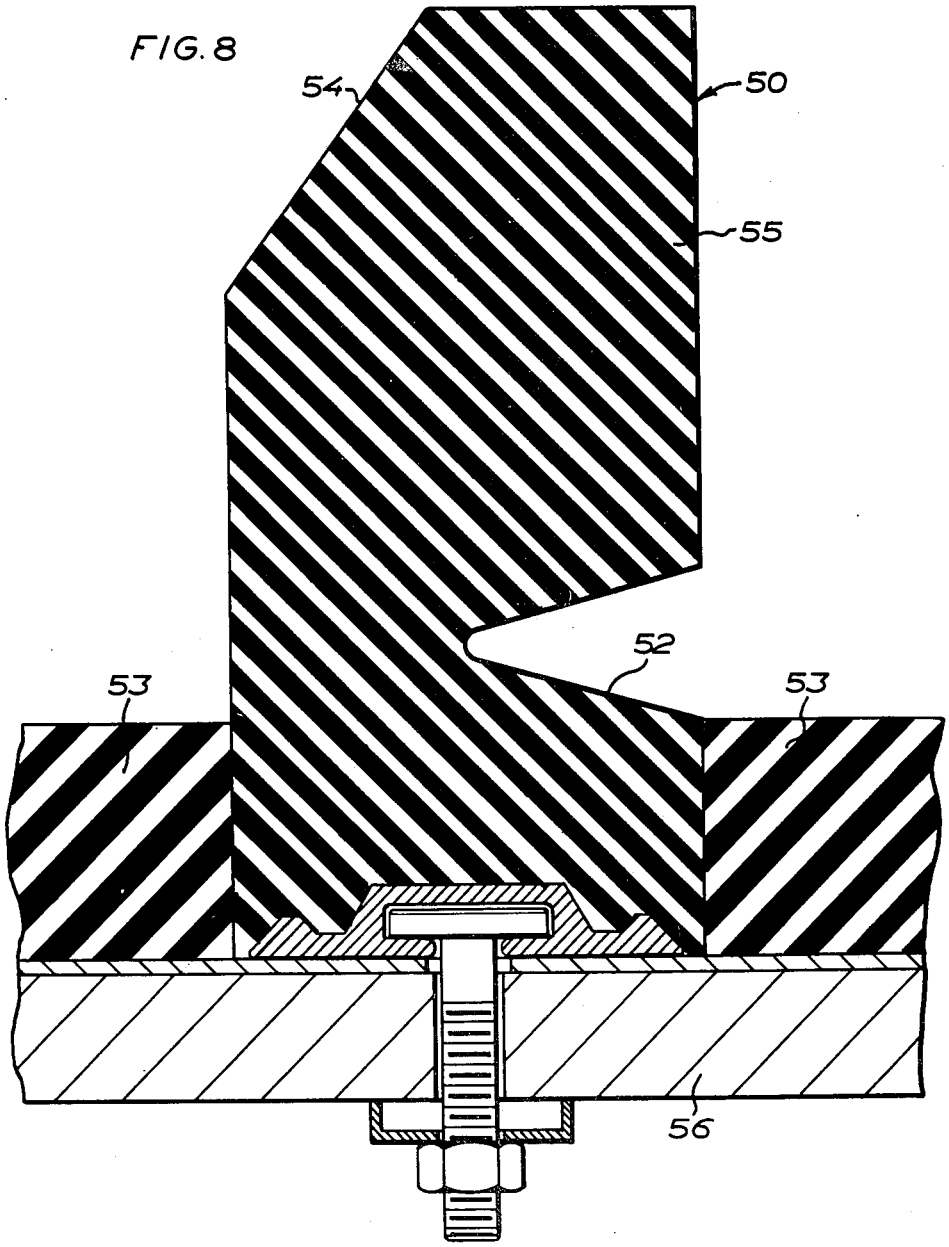

FIG. 8 shows another example of a lifter bar 50 between shell plates 53. The clamping of the lifter bar and the shell plates against the mill drum 56 is effected in the same manner as in the other drawing figures. The lifter bar 50 also has a recess 52 which, in this case, is V-shaped in cross-section and commences on a level with the inside of the shell plate 53. Above the recess 52, there is thus formed a top portion 55, whose rear edge is bevelled with a bevel surface 54. Also in this case, the major part of the strain on the lifter bar will occur in the region of the bottom of the recess 52 where no abrasion by sliding material takes place to any appreciable extent.

Figure 9:
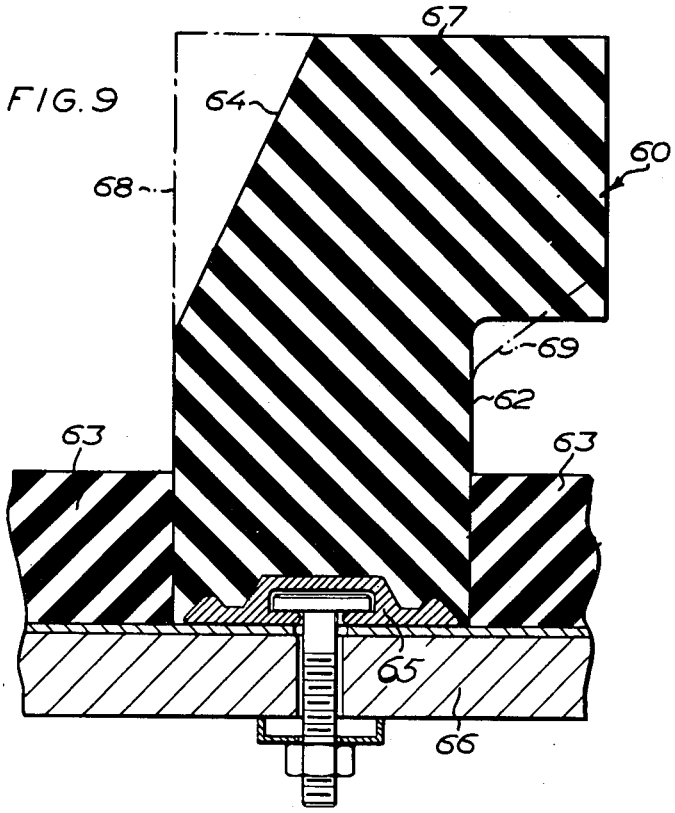

FIG. 9 shows still another example of a lifter bar 60 between shell plates 63. The clamping of the lifter bar and the shell plates against the mill drum 66 is effected in the same manner as in the other drawing figures. This lifter bar 60 also has a recess 62 which, in this case extends down to the channel profile 65, the right-hand shell plate 63 on the drawing extending to the bottom of this recess 62. Above the recess 62 there is thus formed a top portion 67 whose rear edge is bevelled with a bevel surface 64. Also in this case, the major part of the tensile strain on the lifter bar will occcur in the region of the recess 62 just below the transition between the top portion 67 and the upper limit of the recess 62, that is to say at a point where no abrasion by sliding material takes place to any appreciable extent. As is illustrated by means of broken lines 68, the lifter bar may be designed without any bevelling 64 and will then have substantially L-shaped cross-section. However, the bevelling may be advantageous, in particular if the distance between the high lifter bars is short. The corresponding design without bevelling may be used on other embodiments. The dash-dot line 69 shows that the recess 62 may be designed slightly differently, in conformity with that shown in FIG. 3*b*.

Figure 11:
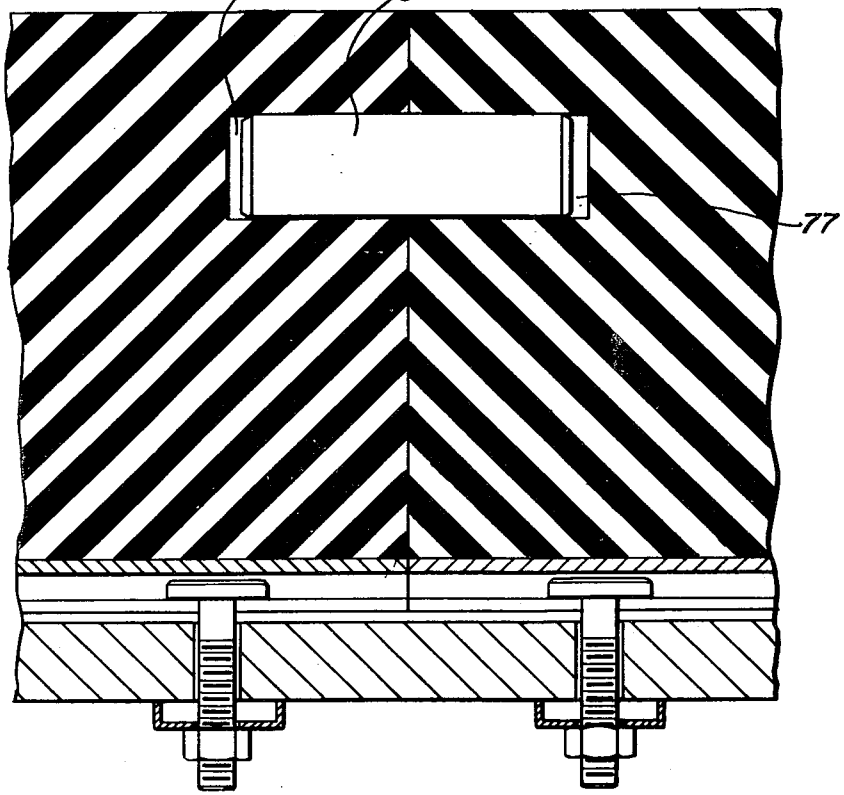
FIG. 11 is a section along the line XI—XI in FIG. 10.
Figure 10:
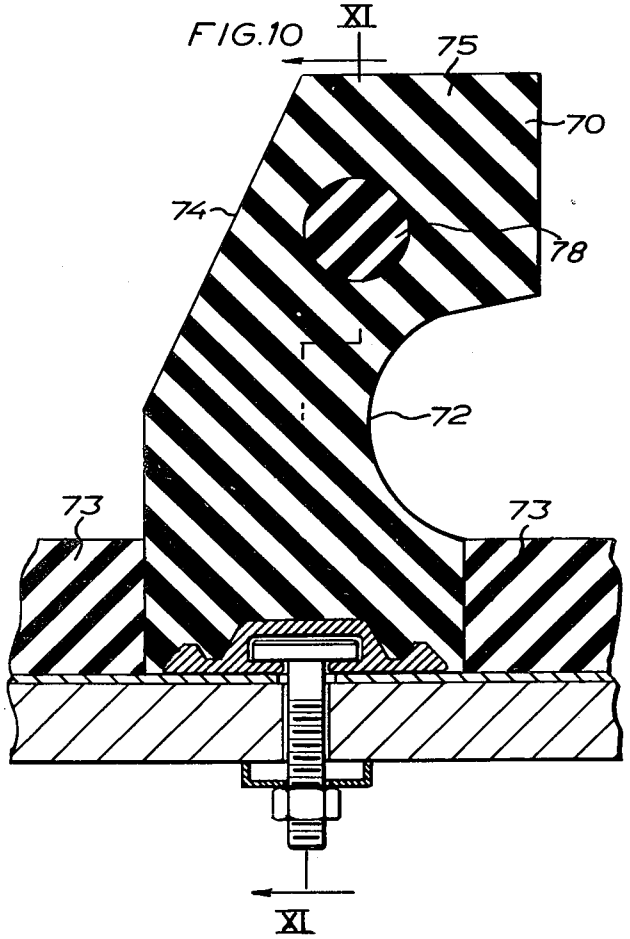
FIG. 10 shows a further example of a lifter bar included in the mill lining according to the present invention.

FIGS. 10 and 11 show still another example of a lifter bar 70 in a lining according to the present invention. This lifter bar also has a recess 72 and is placed between shell plates 73. Like the preceding embodiment, the lifter bar has a bevelled surface 74 and a top portion 75. The lifter bar according to FIGS. 10 and 11 has, however, recesses 77 in its end surfaces for accommodating a rubber plug or other rod 78. This plug or rod 78 is inserted between mutually subsequent lifter bar segments if several such lifter bar segments need to be placed after each other. In this manner, a force transfer will occur from one lifter bar segment to the subsequent lifter bar segment, which may occasionally be advantageous from the point of view of abrasion.

Figure 12:
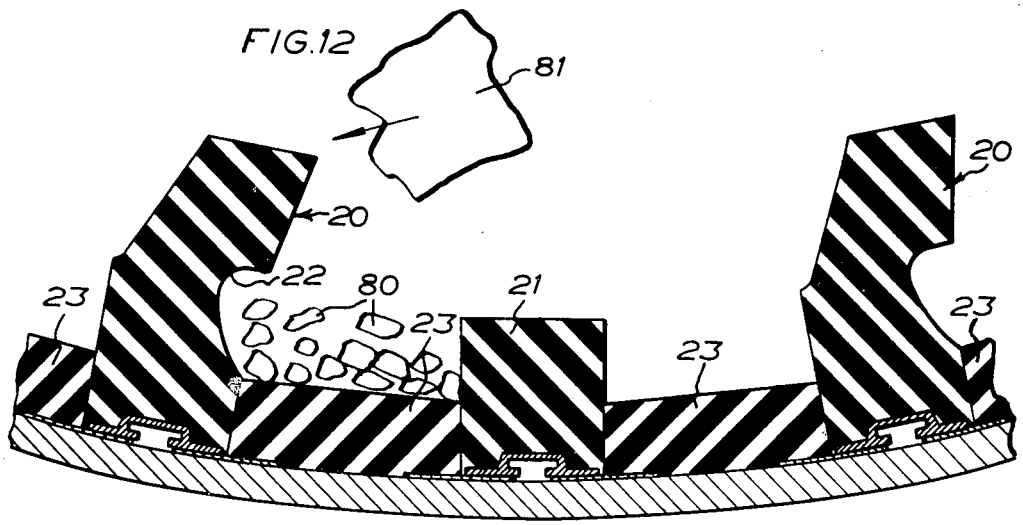
FIG. 12 is a portion of a cross-section through a mill according to the present invention and illustrates the function of the mill lining.

FIG. 12 illustrates the functional principle of a mill lining according to the present invention. As is apparent from this drawing figure, material being ground and being of smaller piece-size will collect above the shell plates 23 and also in the major portion of the recess 22 in the lifter bars 20. This material 80 of smaller piece-size does not move as powerfully as the larger pieces 81 which, on striking the top portion of the lifter bars 20, will cause a bending thereof to the left with respect to FIG. 12, the major strain on the lifter bar 20 occurring in the region about the bottom of the recess 22, where the small material pieces 80 will not exercise any particularly great sliding and abrasive effect.

Figure 13:
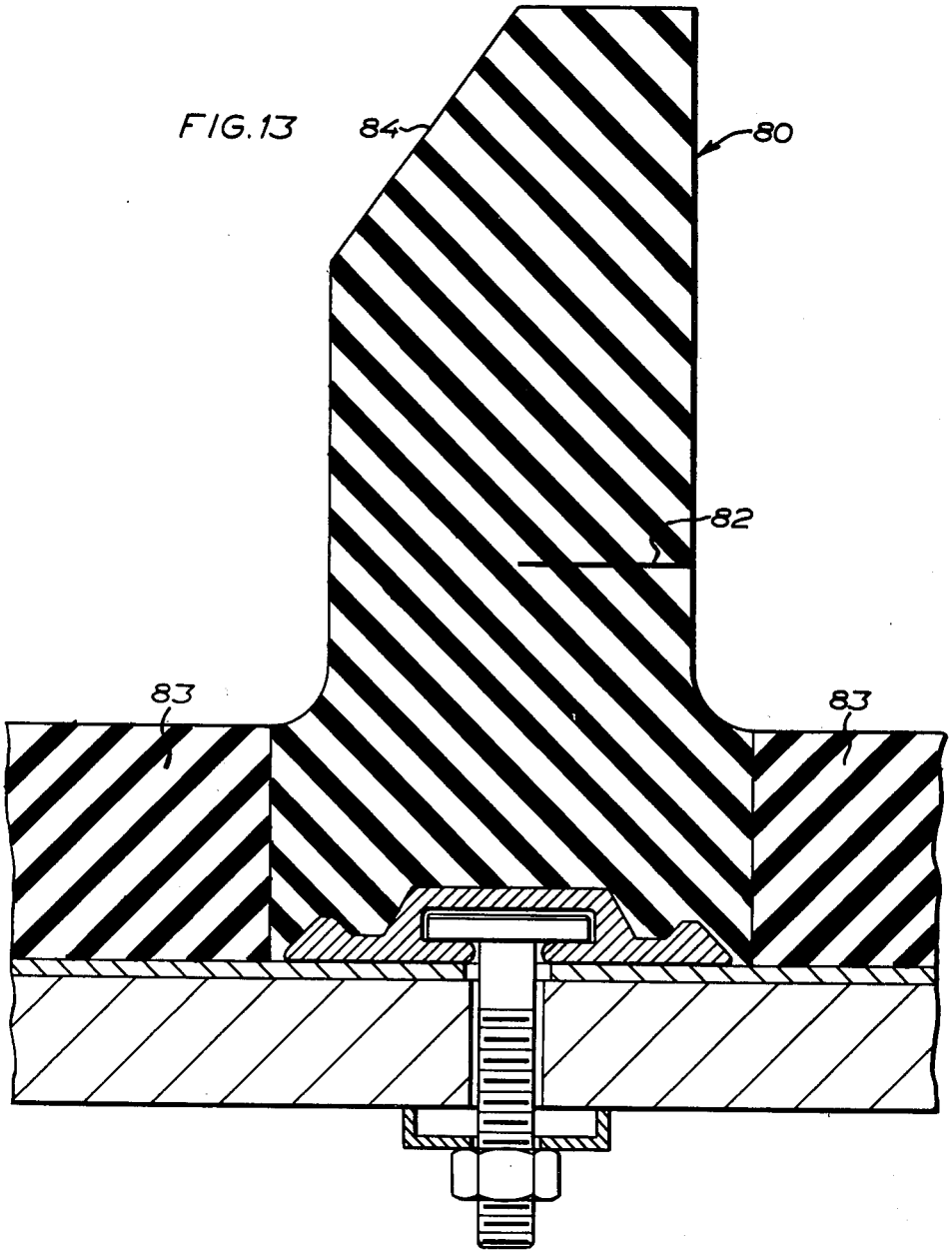
FIG. 13 shows a further example of a lifter bar for the mill lining according to the present invention.

FIG. 13 shows yet another embodiment of a mill lining according to the present invention. In this case, a lifter bar 80 is placed between shell plates 83, and this lifter bar has a longitudinal slot or incision 82 which is provided within the inside of the shell plate 83 and has the same object as the longitudinal recess in the previously described embodiments. This slot or incision has thus been made without any actual removal of elastomer material. This lifter bar also has a bevelled surface 84 on its rearwardly facing side. This lifter bar is, however, not as advantageous as those lifter bars which have a recess forming a groove in conformity with the groove 22 in FIG. 3*b*.

What I claim and desire to secure by Letters Patent is:

1. A mill lining for a mill drum mounted for rotation about an axis, comprising shell plates and lifter bars made of elastomer material, said lifter bars extending substantially in the axial direction of the mill drum and projecting, as seen from the inner surface of said shell plates, inwardly into the mill drum, said lifter bars having longitudinal incisions in their impact sides facing forwardly in the direction of rotation of the mill drum, said incisions being radially inward of the inner surface of said shell plates and spaced radially outwardly from the inner end of the lifter bars to enable said lifter bars to flex primarily at the location of said incisions when material to be milled impacts said lifter bars.

2. A mill lining for a mill drum mounted for rotation about an axis, comprising shell plates and lifter bars made of elastomer material, said lifter bars extending substantially in the axial direction of the mill drum and projecting, as seen from the inner surface of said shell plates, inwardly into the mill drum, at least one of said lifter bars being provided with strain concentrator means for promoting the elastic deflection of the lifter bar when struck by material in the mill and for concentrating the tensile strain on the lifter bar to an area relatively unexposed to sliding abrasion of the material being milled in the apparatus, said strain concentrator means comprising a longitudinal slot located in the lifter bar to cause the lifter bar to flex primarily at the location of said slot when struck by the material being milled, said slot being located radially inward of the inner surface of said shell plates and spaced radially outwardly from the inner end of the lifter bar.

3. The mill lining of claim 2 wherein said lifter bar has a longitudinal protuberance located outboard of said longitudinal slot for forming a longitudinal channel between said protuberance and said shell plates.

4. The mill lining of claim 2, wherein said slot has a substantially V-shaped cross-section.

5. The mill lining of claim 2, wherein said slot has a substantially U-shaped cross-section.

6. The mill lining of claim 2, wherein said slot is an incision cut into said lifter bar.

7. A lifter bar for a mill drum, comprising an elongated elastomer body and mounting means for the same, said elongated elastomer body having a top edge side, a lower mounting edge side and a working major side extending between the mounting edge side and the top edge side, said elastomer body having strain concentrator means for promoting the elastic deflection of the lifter bar when struck by material in the mill and for concentrating the tensile strain on the lifter bar to an area relatively unexposed to sliding abrasion of the material being milled in the apparatus, said strain concentrator means comprising a longitudinal slot in the working major side at a distance from the top and mounting edge sides to cause the lifter bar to flex primarily at the location of said slot when struck by the material being milled.

8. The lifter bar of claim 7, wherein said slot is of substantially V-shaped cross-section.

9. The lifter bar of claim 7, wherein said slot is of substantially U-shaped cross-section.

10. The lifter bar of claim 7, wherein said elastomer body is of substantially C-shaped cross-section.

* * * * *